US006737594B2

(12) United States Patent
Helms et al.

(10) Patent No.: US 6,737,594 B2
(45) Date of Patent: May 18, 2004

(54) LOCKING ATTACHMENT FOR AN ELECTRICAL SWITCHING APPARATUS

(75) Inventors: Roger W. Helms, Beaver Falls, PA (US); Craig J. Puhalla, Moon Township, PA (US); Raymond P. Gundy, II, Indiana, PA (US); Percy J. Lipsey, II, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/274,772

(22) Filed: Oct. 21, 2002

(65) Prior Publication Data

US 2004/0074744 A1 Apr. 22, 2004

(51) Int. Cl.[7] ..... H01H 9/28
(52) U.S. Cl. ..... 200/43.14; 200/43.19
(58) Field of Search ..... 200/43.01, 43.11, 200/43.16, 43.19, 43.21, 50.37, 50.09, 50.32, 334, 43.14–43.25; 70/199–203

(56) References Cited

U.S. PATENT DOCUMENTS

| | | | | |
|---|---|---|---|---|
| 2,568,423 A | | 9/1951 | Walker et al. | |
| 2,832,857 A | | 4/1958 | Landmeier | |
| 2,849,552 A | | 8/1958 | Firestone | |
| 2,937,248 A | | 5/1960 | Michetti | |
| 3,214,530 A | * | 10/1965 | Tharp et al. | 200/43.15 |
| 3,408,466 A | | 10/1968 | Palmer | |
| 4,300,030 A | | 11/1981 | Dimarco et al. | |
| 4,347,412 A | * | 8/1982 | Mihara et al. | 200/43.21 |
| 4,435,624 A | | 3/1984 | Sepulveda | |
| 4,581,502 A | | 4/1986 | Grudzinskas | |
| 5,065,918 A | | 11/1991 | Chun et al. | |
| 5,147,991 A | | 9/1992 | Jordan, Sr. | |
| 5,219,070 A | | 6/1993 | Grunert et al. | |
| 5,310,969 A | * | 5/1994 | Turek et al. | 200/43.14 |
| 5,331,122 A | | 7/1994 | Winder | |
| 5,341,191 A | | 8/1994 | Crookston et al. | |
| 5,412,167 A | | 5/1995 | Mueller et al. | |
| D365,547 S | | 12/1995 | Steinwachs et al. | |
| 5,500,495 A | | 3/1996 | Benda et al. | |
| 5,577,599 A | | 11/1996 | Turek et al. | |
| 5,732,815 A | | 3/1998 | Brouwer | |
| 5,831,503 A | | 11/1998 | Beck et al. | |
| 6,160,227 A | | 12/2000 | Singer | |
| D448,008 S | | 9/2001 | Singer | |

* cited by examiner

*Primary Examiner*—Elvin Enad
*Assistant Examiner*—M. Fishman
(74) *Attorney, Agent, or Firm*—Martin J. Moran

(57) ABSTRACT

A locking attachment is for a circuit breaker. The circuit breaker includes a housing enclosing separable contacts and an operating mechanism, an elongated operating member with a handle that operates to open and close the separable contacts, and an opening in the housing through which the elongated operating member protrudes. The opening has first and second ends corresponding to "on" and "off" circuit breaker positions, respectively. The locking attachment includes a locking member having a first end having a compressive segment with opposed portions for compressively capturing the operating member. The second end of the locking member is structured to engage the housing of the circuit breaker at one of the first and second ends of the opening in the housing, thereby locking the circuit breaker in either the "on" or "off" position.

6 Claims, 5 Drawing Sheets

LOCKING ATTACHMENT FOR AN ELECTRICAL SWITCHING APPARATUS

BACKGROUND OF THE INVENTION

1. Field of the Invention

The present invention relates generally to electrical switching apparatus and, more particularly, to a locking attachment for the handle of a circuit breaker.

2. Background Information

Electrical switching apparatus include, for example, circuit switching devices and circuit interrupters such as circuit breakers, contactors, motor starters, motor controllers and other load controllers.

Circuit breaker generally old and well known in the art. An example of a circuit breaker is disclosed in U.S. Pat. No. 5,341,191. Circuit breakers are used to protect electrical circuitry from damage due to an overcurrent condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an overcurrent condition.

Circuit breakers typically have three possible operating handle positions, corresponding to the status of the separable contacts. For example, these positions may include an ON position, in which the separable contacts are closed, an OFF position in which the contacts are open, and a tripped position in which the contacts are tripped open. Typically, the handle position corresponding to the tripped position of the contacts is in between the ON and OFF positions.

In circuit breaker installations, for example in a panel board or load center, it is often desirable or essential that the settings of a single circuit breaker, or a group of circuit breakers, remain undisturbed. Unauthorized or inadvertent changing of the position of these breakers could result in annoying interruptions to service or operations, serious damage to an electrical apparatus, or even serious harm to a person. For example, accidental actuation of a circuit breaker might result in electrocution or shock to a workman performing electrical work or repair within an office building or home. Therefore, to prevent another person from inadvertently returning the circuit breaker handle to the ON position when a worker is doing electrical work in an area other than the immediate vicinity of the circuit breaker box or electrical panel, safety measures must be taken. One such safety measure is the addition of a locking mechanism to prevent displacement of the circuit breaker handle.

Although the main purpose of a circuit breaker is to trip during overload or short circuit conditions in order to protect downstream equipment and electrical wiring from damage, it may also be highly desirable to inhibit the circuit interruption function under certain conditions where, for example, the potential fire hazard of a non-opening circuit breaker is deemed to be a lesser hazard than if current flow to downstream devices is interrupted. The decision to accept the risk of fire over some other hazardous consequence may occur during emergencies or other critical situations where loss of life might occur if power is disrupted. Conceivable situations include, for example, circuit breakers employed in connection with combat (e.g., in a battleship under wartime conditions), fire-fighting (e.g., energizing pumps for pumping water to fire hoses in a high-rise building), spacecraft launch (e.g., energizing ground-based circuits critical to a safe launch), mining (e.g., energizing pumps employed to rapidly remove water from a flooded mine shaft), or nuclear power generation (e.g., energizing circuits critical to tripping a nuclear reactor). See, for example, U.S. Pat. No. 5,831,503. Although most circuit breakers can still trip internally even if the handle is held in the on position, a locking mechanism to prevent displacement of the circuit breaker handle would preclude manual operation that might inadvertently remove power in a critical situation.

U.S. Pat. Nos. 2,937,248 and 4,581,502 disclose a handle lock for a circuit breaker, which employs a bent piece of resilient wire material. A portion of the wire is inserted through a bore in the circuit breaker handle. The wire is then pivoted about the handle bore into a locking position within a recess in the switch housing.

U.S. Pat. Nos. 2,849,552; 3,408,466; 5,147,991; 5,219,070; 5,412,167; 5,500,495; 5,577,599; and 5,732,815 disclose handle locking mechanisms consisting of an assembly of at least two parts and each employs a padlock to lock the handle of the circuit breaker in a fixed position. Many known locking mechanisms of this type further employ a set or Allen screw to engage the circuit breaker handle, in order to prohibit its movement. See, e.g., U.S. Pat. Nos. 2,849,552; 5,147,991; 5,500,495; and 5,732,815.

U.S. Pat. No. 2,832,857 discloses a one-piece locking mechanism consisting of a metallic plate placed over the circuit breaker handle and locked into place by tangs which insert under the edge of the slot in the switch housing.

U.S. Pat. No. 4,435,624 discloses a lock off-lock on comprising a metal stamping that can be press fitted. A first handle-engaging portion, formed into a U-shaped structure, is inserted into an opening on the circuit breaker handle. A second handle-engaging portion is adapted to engage a surface of the handle adjacent to a dependent arcuate portion of the handle. A flat spring coupled to the side of the second handle engaging portion is engageable with the dependent arcuate portion and abuts the housing of the switch.

U.S. Pat. No. 6,160,227 discloses a retaining element for a toggle switch having a cylindrical rod-like extension inserted through a hole in the toggle switch and two arms adapted to interlock with a portion of the switch body and prevent displacement of the toggle.

There is room for improvement in locking mechanisms for electrical switching apparatus.

SUMMARY OF THE INVENTION

This need and others are satisfied by the invention, which is directed to a locking attachment for an electrical switching apparatus, which compressively captures an elongated operating member, and engages a housing in order to restrain movement of the operating member.

As one aspect of the invention, a locking attachment is used with an electrical switching apparatus, which includes a housing having an aperture with a first end and a second end, and also includes an elongated operating member protruding from the aperture, the elongated operating member moving between a first position proximate the first end of the aperture and a second position proximate the second end of the aperture, the locking attachment comprises: a locking member including a first end and a second end, the first end of the locking member having a compressive segment with opposed portions structured to compressively capture the elongated operating member between the opposed portions, the second end of the locking member structured to engage the housing at one of the first and second ends of the aperture, in order to restrain movement of the elongated operating member.

The elongated operating member may have an oblong shape with a first external portion positioned away from the aperture, and a second smaller external portion proximate the aperture. The first external portion of the oblong shape of the elongated operating member may have a first diameter, and the compressive segment of the locking member may have a capturing recess with a second diameter, which is smaller than the first diameter.

As another aspect of the invention, an electrical switching apparatus comprises: a housing including an opening having a first end and a second end; separable contacts; an operating mechanism including an elongated operating handle structured to open and close the separable contacts, the elongated operating handle protruding from the opening of the housing and moving between a first position proximate the first end of the opening and a second position proximate the second end of the opening; and a locking member including a first end and a second end, the first end of the locking member having a compressive segment with opposed portions structured to compressively capture the elongated operating handle between the opposed portions, the second end of the locking member structured to engage the housing at one of the first and second ends of the opening, in order to restrain movement of the elongated operating handle.

As another aspect of the invention, an electrical switching apparatus comprises: a housing including at least one opening having a first end and a second end; at least one pair of separable contacts; an operating mechanism including at least one elongated operating handle, each of the at least one elongated operating handles structured to open and close a corresponding pair of the at least one pair of separable contacts, each of the at least one elongated operating handle protruding from the at least one opening of the housing and moving between a first position proximate the first end of the at least one opening and a second position proximate the second end of the at least one opening; and a locking attachment comprising: a locking member including a first end and a second end, the first end of the locking member having a compressive segment with opposed portions structured to compressively capture one of the at least one elongated operating handle between the opposed portions, the second end of the locking member structured to engage the housing at one of the first and second ends of the at least one opening of the housing, in order to restrain movement of the one of the at least one elongated operating handle.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a circuit breaker, although it will become apparent that it could also be applied to other types of electrical switching apparatus (e.g., without limitation, circuit switching devices and other circuit interrupters such as contactors, motor starters, motor controllers and other load controllers).

Figure 1:
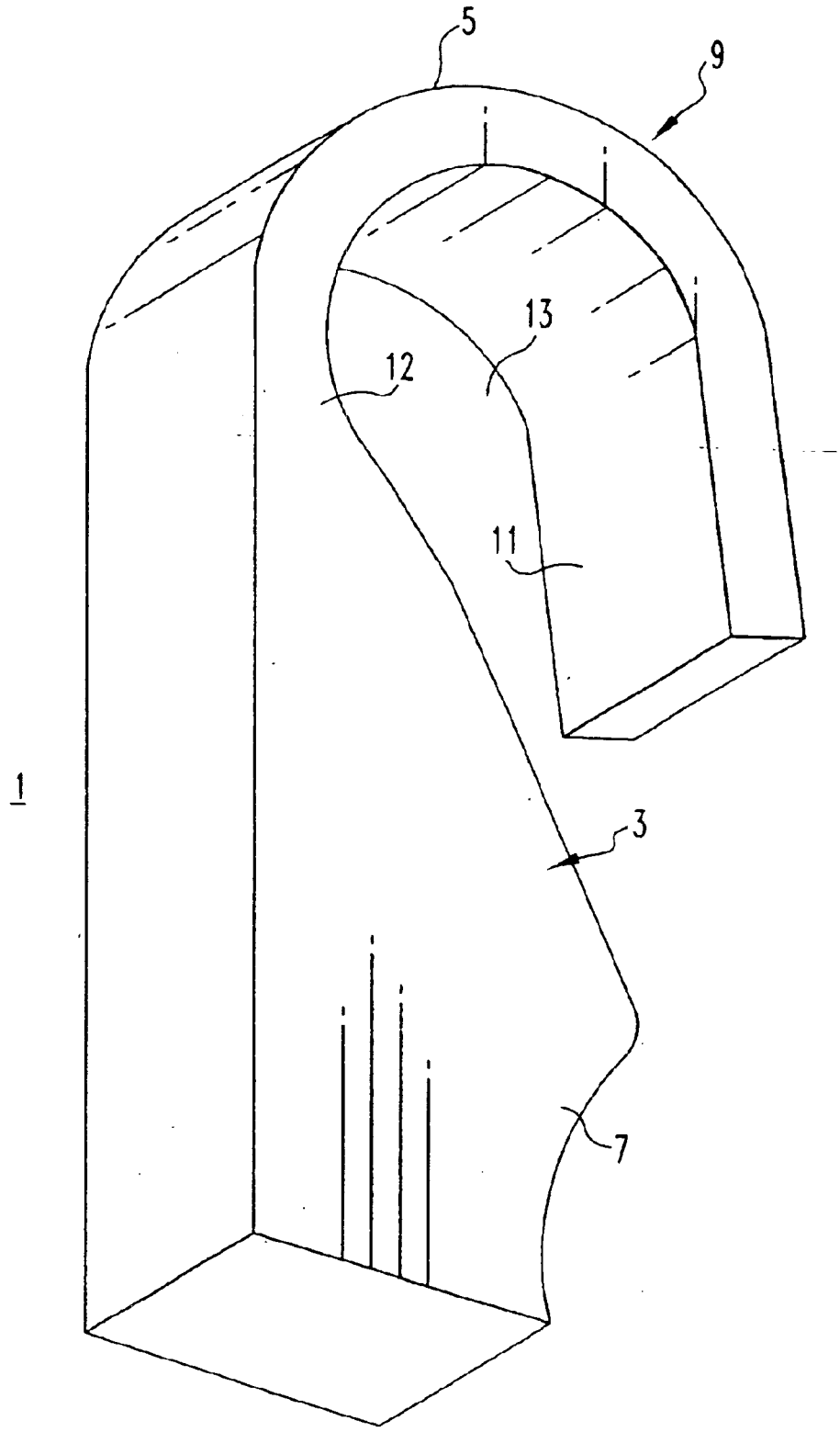
FIG. 1 is an isometric view of a switch locking attachment in accordance with the present invention.

FIG. 1 shows a switch locking attachment 1 including a locking member 3 having a first end 5 and a second end 7. The first end 5 has a compressive segment 9 with opposed portions 11,12.

Figure 2:
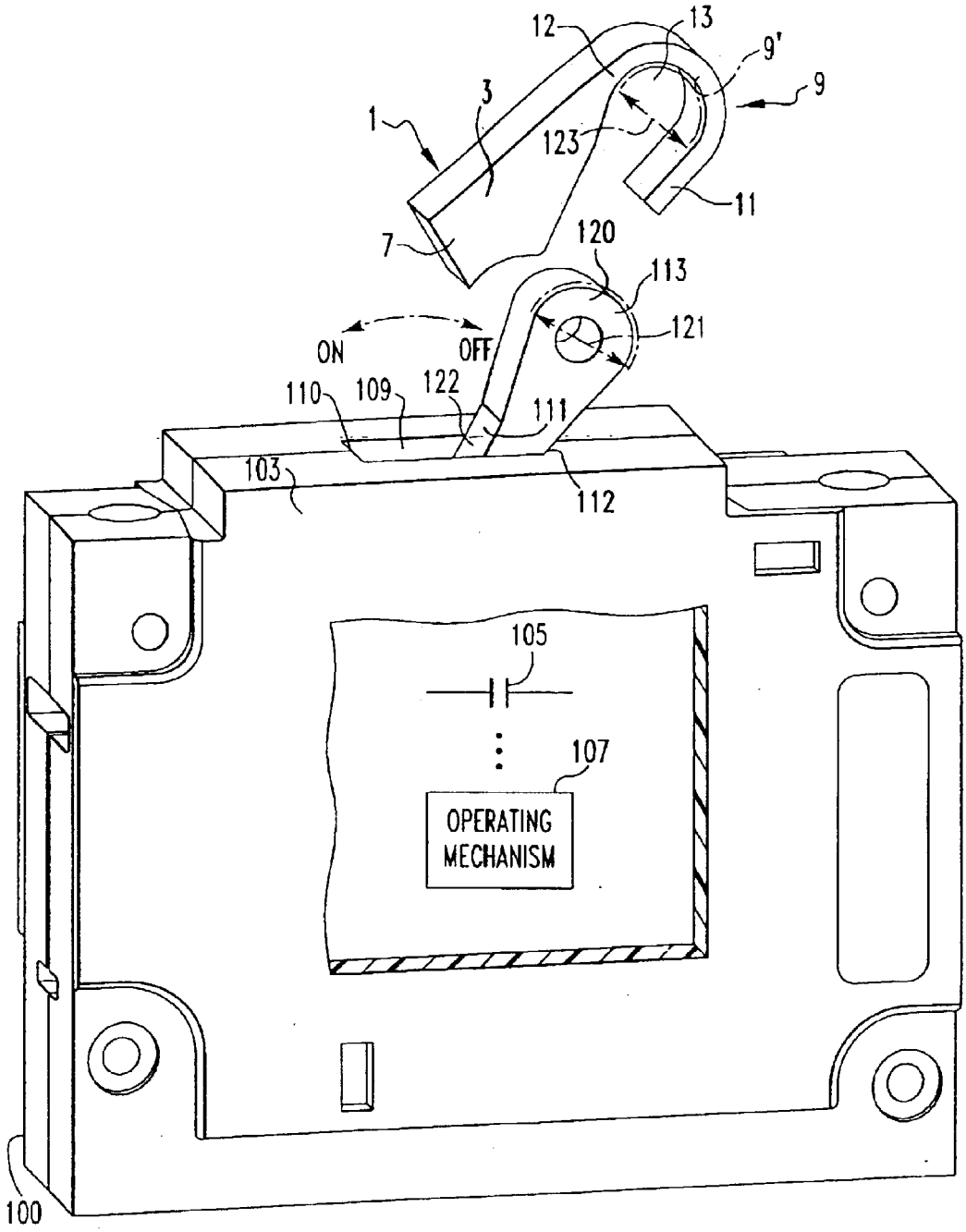
FIG. 2 is an exploded, isometric view of a single-pole circuit breaker, with the circuit breaker housing partially cut-away to show internal structures, and the locking attachment of FIG. 1.

FIG. 2 illustrates the basic components of a circuit breaker 100, including a housing 103 enclosing separable contacts 105 and an operating mechanism 107 which opens and closes the separable contacts 105. The circuit breaker 100 further includes an aperture or opening 109 in the housing 103 and a pivoting elongated operating member 111 having a handle 113 which protrudes from the aperture 109. The handle 113 can be pivoted between a first end 110 in the aperture 109, corresponding to an "on" position in which the separable contacts 105 are closed, and a second end 112 in aperture 109, corresponding to an "off" position in which the separable contacts 105 are open.

In use, the locking attachment 1 is placed over the handle 113 of the circuit breaker 100 in either the "on" position or the "off" position depending on the user's preference. As shown in FIGS. 2–5, the compressive segment 9 of the locking member 3 is structured so that the opposed portions 11,12 of the compressive segment 9 compressively capture the handle 113 of the elongated operating member 111. The second end 7 of the locking member 3 is structured to engage the housing 103 at one of the first and second ends 110,112 (as shown with end 110 of FIG. 2) of the aperture 109, in order to restrain movement of the elongated operating member 111.

As illustrated in FIG. 2, the elongated operating member 111 may be oblong shaped with a first external portion 120 positioned away from the aperture 109, and a second smaller external portion 122 proximate the aperture. The compressive segment 9 of the locking member 3 has a capturing recess 13 with a diameter 123 slightly smaller than the diameter 121 of the elongated operating member 111 and is, thereby, structured to compressively capture the circuit breaker handle 113 within the capturing recess 13.

Figure 3:
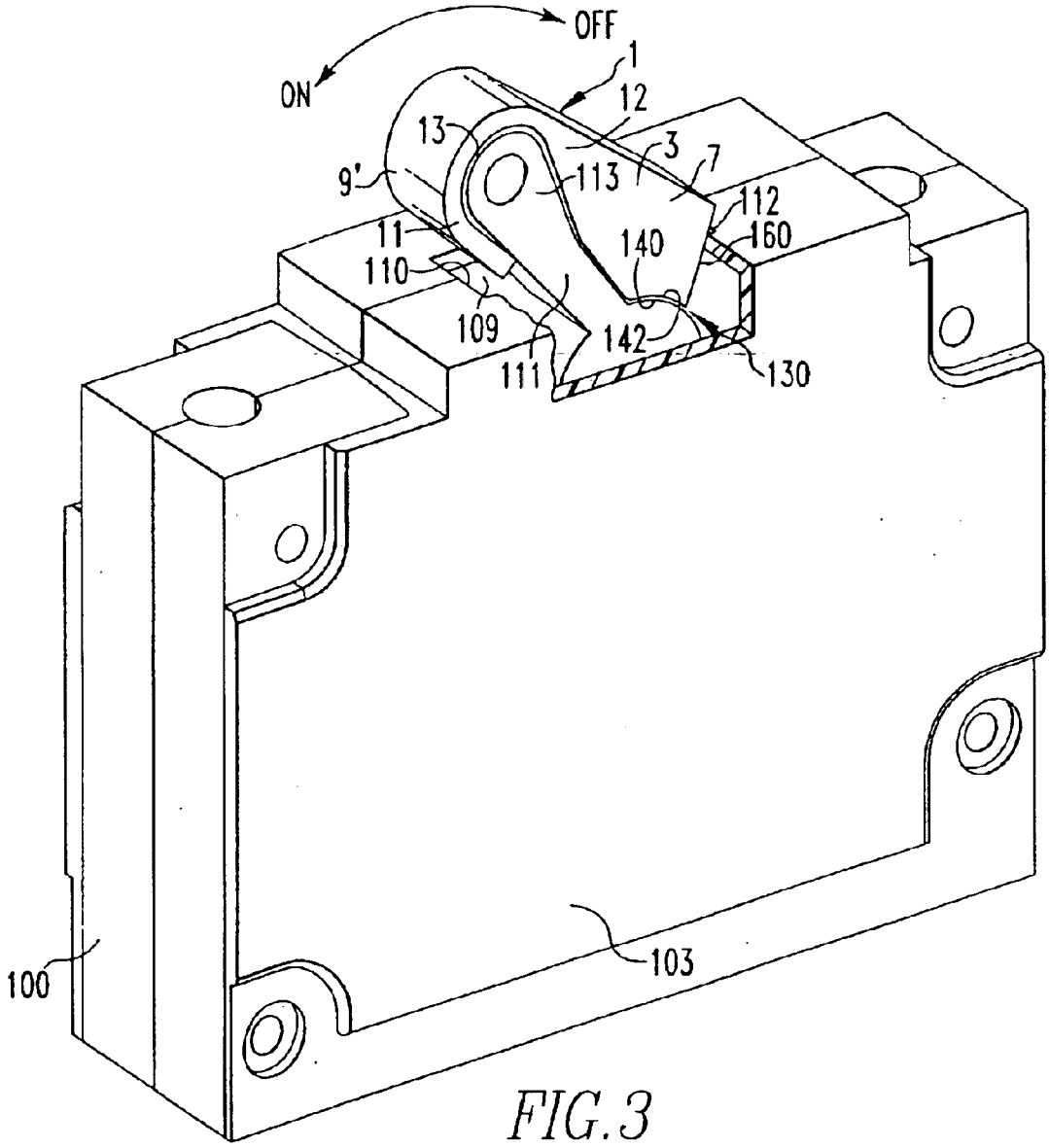
FIG. 3 is an isometric view of the assembly of the locking attachment and circuit breaker of FIG. 2, with the housing partially cut-away to show the locking attachment engagement portion located within the circuit breaker housing.

Referring to FIG. 3, the second end 7 of the locking member 3 is structured to mate with both the housing 103 at one of the first and second ends 110,112 (as shown with end 112 of FIG. 3) of the aperture 109, and the elongated operating member 111 within the housing 103 in order to form a conforming wedge 130 therebetween to restrain movement of the elongated operating member 111.

In the embodiment of FIG. 3, the compressive segment 9 is a hook-shaped compression clip 9', which compressively captures the handle 113 of the circuit breaker 100. Additionally, the elongated operating member 111 includes an arcuate portion 140 within the housing 103. The second end 7 of the locking member 3 has a corresponding arcuate portion 142 structured to engage the arcuate portion 140 of the elongated operating member 111 within the housing 103. The second end 7 of the locking member 3 further includes a non-arcuate portion 160 adjacent to the corresponding arcuate portion 142. This non-arcuate portion 160 engages the circuit breaker housing 103 at one of the first and second ends 110,112 (as shown with end 112 of FIG. 3) of the aperture 109, as the corresponding arcuate portion 142 of the locking member 3 simultaneously engages the arcuate portion 140 of the elongated operating member 111. The result is that the second end 7 of the locking member 3 forms the conforming wedge 130 that restrains movement of the elongated operating member 111 from the "on" position of FIG. 3 (or from the "off" position of FIG. 2).

Figure 4:
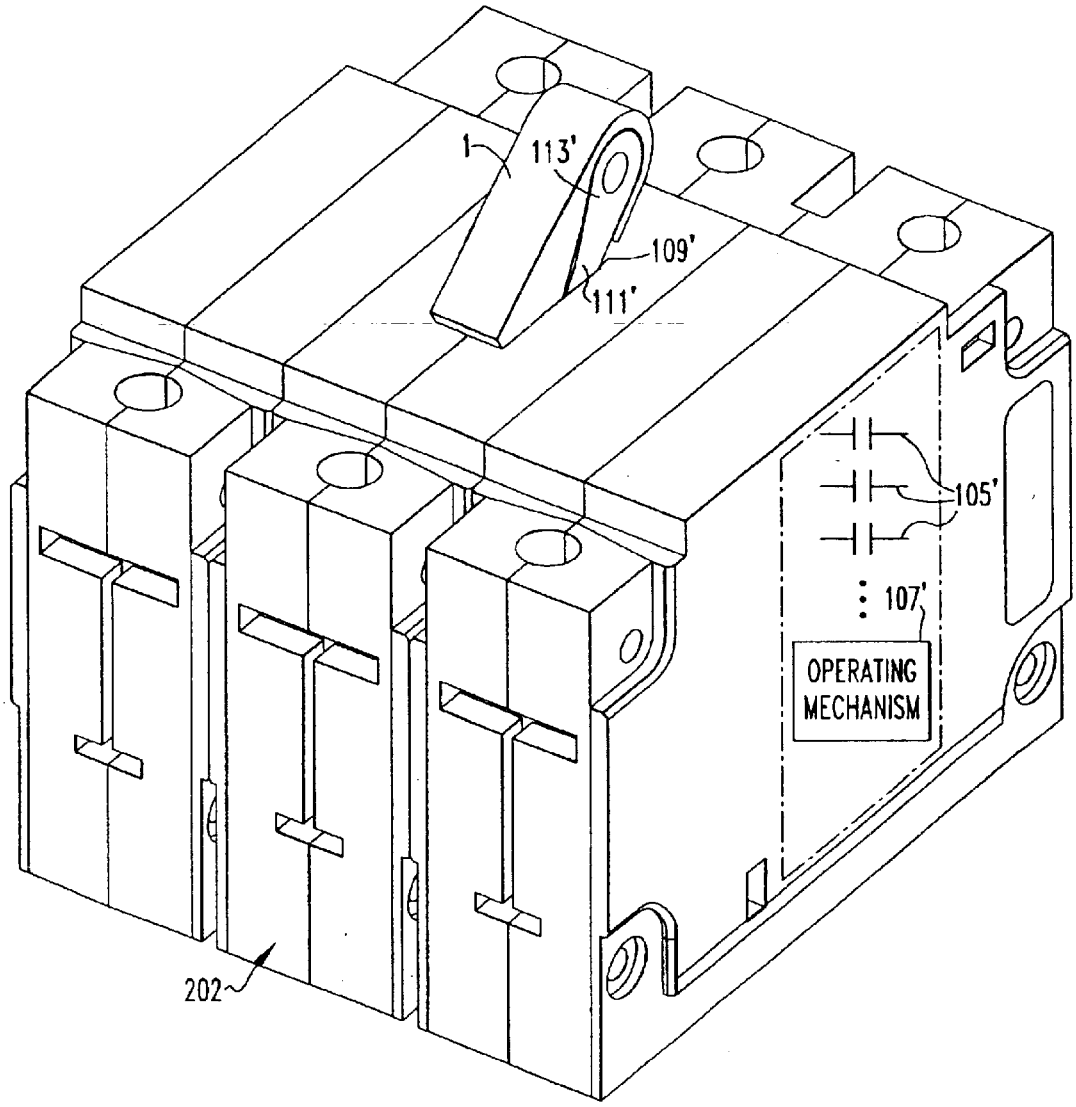
FIG. 4 is an isometric view of the assembly of the locking attachment of FIG. 1 as employed on a three-pole circuit breaker in accordance with an embodiment of the invention, with the circuit breaker housing partially cut-away to show internal structures.
Figure 5:
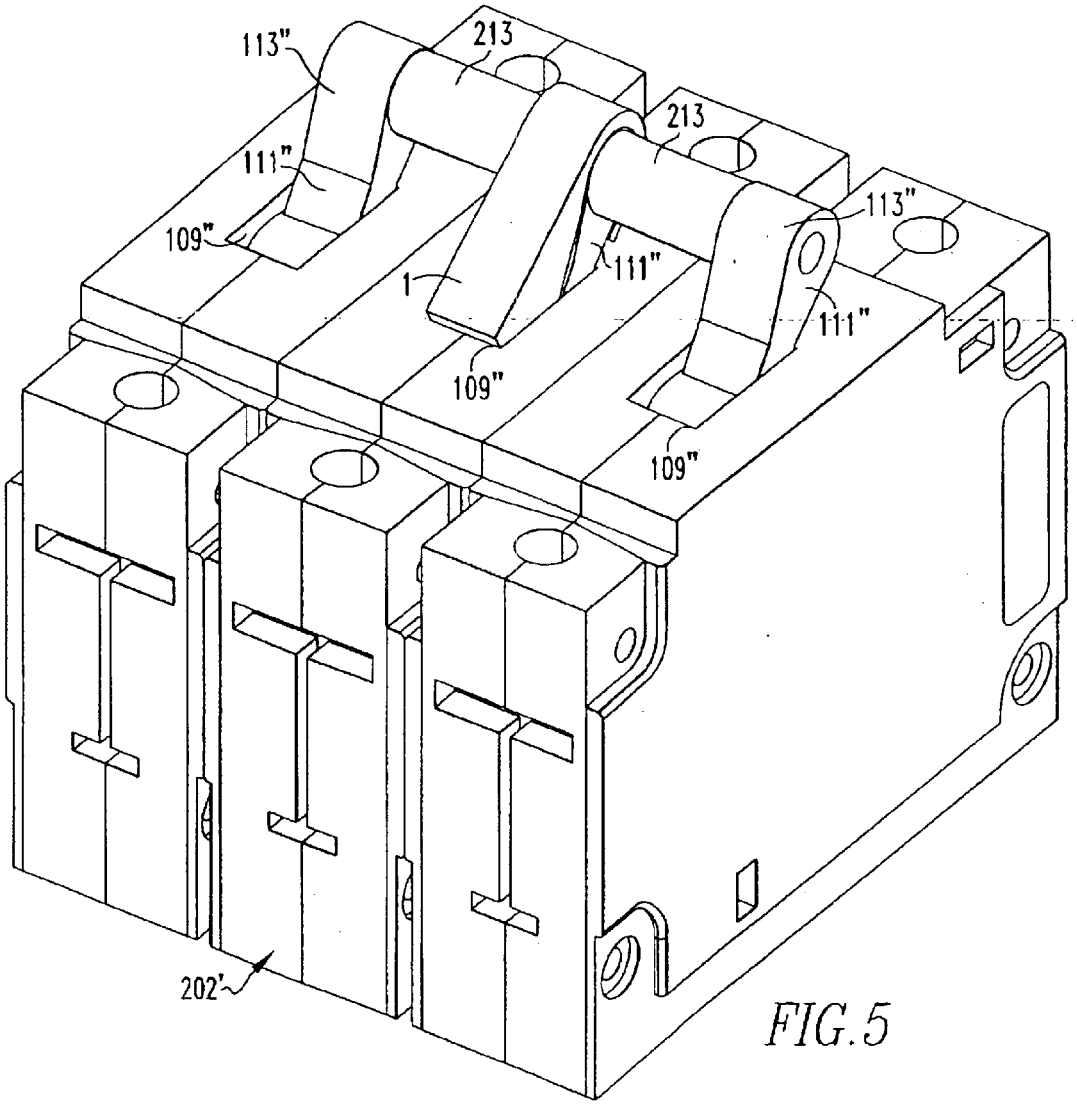
FIG. 5 is an isometric view of the locking attachment of FIG. 1 engaging a ganged operating handle of a three-pole circuit breaker in accordance with another embodiment of the invention.

The locking attachment 1 may be employed in a variety of applications in connection with a wide range of electrical switching apparatus. Two such applications are shown in FIGS. 4 and 5. FIG. 4 shows an embodiment of the locking attachment 1 as employed on a multi-pole circuit breaker, such as three-pole circuit breaker 202 with a single aperture 109' and a single elongated operating member 111' and handle 113'. The three-pole circuit breaker 202 includes three sets of separable contacts 105' and an operating mechanism 107'. However, one skilled in the art will appreciate that the locking attachment 1 can be employed on a circuit breaker having any number of poles, with any number of apertures, and any number of elongated operating members and handles. Additionally, when used on a multi-pole circuit breaker with a plurality of handles, one or more locking attachments 1 can be placed on any number of elongated operating members in a wide array of possible switch position combinations (not shown). For example, on a three-pole circuit breaker with three separate operating handles (not shown), two locking attachments 1 could be employed, one locking a first operating handle in the "on" position and another locking a second operating handle in the "off" position, with the third operating handle not using a locking attachment 1.

Referring to FIG. 5, the locking attachment 1 may be used to restrain a multi-pole circuit breaker, such as three-pole circuit breaker 202', with a plurality of elongated operating members 111" having handles 113" linked to form a single ganged operating handle 213. The three-pole circuit breaker 202' includes three separate apertures 109" and three handles 113" linked together into one ganged handle 213. The locking attachment 1 is employed on the center elongated operating member 111" to restrain movement of all three elongated operating members 111" and the ganged operating handle 213. One skilled in the art will appreciate that one or more locking attachments 1 may be employed on a single-pole circuit breaker, on multi-pole circuit breakers having any number of poles, and on any combination of ganged handles or single handles, in a variety of configurations (not shown).

The locking attachment 1 may be made from a wide array of materials including, without limitation, thermoplastic or spring stock. The locking attachment 1 may also be made using a wide variety of manufacturing processes, including, without limitation, forming, molding, casting, or stamping. The exemplary locking attachment 1 is a one-piece locking member 3. However, the locking attachment 1 may be constructed from more than one segment and from more than one type of material, with each separate segment being coupled together to form a one-piece locking assembly. Additionally, although the exemplary locking member 3 employs a hook-shaped compression clip 9', a wide variety of differently shaped compressive segments 9 may be used. For example, without limitation, a U-shaped or a C-shaped compressive segment may be employed to capture an operating handle (not shown).

This one-piece, simplistic and readily attachable locking mechanism is a valuable safety feature and added security measure for electrical switching applications where maintaining the switch handle position status quo is critical. The invention reduces the cost of manufacture and offers simplified attachment over the known prior art by eliminating unnecessary, cumbersome parts and by replacing complex designs with a one-piece locking member 3 that can be readily attached to an electrical switching apparatus without the need for tools.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A locking attachment for use with an electrical switching apparatus, said electrical switching apparatus including a housing having an aperture with a first end and a second end, said electrical switching apparatus also including an elongated operating member protruding from said aperture, said elongated operating member moving between a first position proximate the first end of said aperture and a second position proximate the second end of said aperture, said locking attachment comprising:

a locking member including a first end and a second end, the first end of said locking member having a compressive segment with opposed portions structured to compressively capture said elongated operating member between said opposed portions, the second end of said locking member structured to engage said housing at one of the first and second ends of said aperture, in order to restrain movement of said elongated operating member;

wherein said elongated operating member has an oblong shape with a first external portion positioned away from said aperture, and a second smaller external portion proximate said aperture; and wherein the first external portion of the oblong shape of said elongated operating member has a first diameter, wherein the compressive segment of said locking member has a capturing recess with a second diameter, which is smaller than said first diameter.

2. The locking attachment of claim 1 wherein the compressive segment of said locking member is a hook-shaped compression clip including said capturing recess to compressively capture said first diameter of the first external portion of the oblong shape of said elongated operating member.

3. An electrical switching apparatus comprising:

a housing including an opening having a first end and a second end;

separable contacts;

an operating mechanism including an elongated operating handle structured to open and close said separable contacts, said elongated operating handle protruding from the opening of said housing and moving between a first position proximate the first end of said opening and a second position proximate the second end of said opening;

a locking member including a first end and a second end, the first end of said locking member having a compressive segment with opposed portions structured to compressively capture said elongated operating handle between said opposed portions, the second end of said locking member structured to engage said housing at one of the first and second ends of said opening, in order to restrain movement of said elongated operating handle; and wherein said elongated operating handle bas an oblong shape with a first external portion positioned away from said opening, and a second smaller external portion proximate said opening; wherein the first external portion of the oblong shape of said elongated operating handle has a first diameter; and wherein the first end of said locking member has a capturing recess with a second diameter, which is smaller than said first diameter of the first external portion of the oblong shape of said elongated operating handle.

4. The electrical switching apparatus of claim 3 wherein the compressive segment of said locking member is a hook-shaped compression clip including said capturing recess to compressively capture said first diameter of the first external portion of the oblong shape of said elongated operating handle.

5. An electrical switching apparatus comprising:

a housing including at least one opening having a first end and a second end;

at least one pair of separable contacts;

an operating mechanism including at least one elongated operating handle, each of said at least one elongated operating handle structured to open and close a corresponding pair of said at least one pair of separable contacts, each of said at least one elongated operating handle protruding from said at least one opening of said housing and moving between a first position proximate the first end of said at least one opening and a second position proximate the second end of said at least one opening;

a locking attachment comprising:

a locking member including a first end and a second end, the first end of said locking member having a compressive segment with opposed portions structured to compressively capture one of said at least one elongated operating handle between said opposed portions, the second end of said locking member structured to engage said housing at one of the first and second ends of said at least one opening of said housing, in order to restrain movement of said one of said at least one elongated operating handle; and wherein said at least one elongated operating handle has an oblong shape with a first external portion positioned away from said at least one opening of said housing, and a second smaller external portion proximate said at least one opening; wherein the first external portion of the oblong shape of said at least one elongated operating handle has a first diameter; and wherein the first end of said locking member has a capturing recess with a second diameter, which is smaller than said first diameter of the first external portion of the oblong shape of said at least one elongated operating handle.

6. The electrical switching apparatus of claim 5 wherein said compressive segment of said locking member is a hook-shaped compression clip including said capturing recess to compressively capture said first diameter of the first external portion of the oblong shape of said at least one elongated operating handle.

* * * * *